US005372164A

United States Patent [19]

Cloer

[11] Patent Number: 5,372,164

[45] Date of Patent: Dec. 13, 1994

[54] QUICK CHANGE ASSEMBLY FOR TIRE CORD FABRIC LOOMS

[75] Inventor: Carroll M. Cloer, Gastonia, N.C.

[73] Assignee: Bridgestone/Firestone, Inc., Akron, Ohio

[21] Appl. No.: 172,342

[22] Filed: Dec. 23, 1993

[51] Int. Cl.[5] ..... D03J 5/08

[52] U.S. Cl. ..... 139/97; 139/192; 139/1 R; 28/193; 28/212; 242/131.1

[58] Field of Search ..... 139/97, 192, 1 R, 11, 139/DIG. 1, 457; 28/212, 199, 213, 193; 242/131.1

[56] References Cited

U.S. PATENT DOCUMENTS

| | | | |
|---|---|---|---|
| 1,312,847 | 8/1919 | Hirst | 242/131.1 |
| 1,523,999 | 1/1925 | Hathaway . | |
| 1,834,328 | 12/1931 | Bellhouse | 28/199 X |
| 2,325,974 | 8/1943 | Pasquerello | 242/131.1 |
| 2,360,558 | 10/1944 | Gebert et al. | 242/131.1 X |
| 2,537,007 | 1/1951 | Abbott, Jr. . | |
| 3,520,493 | 7/1970 | Carroll . | |
| 3,575,359 | 4/1971 | Furst . | |
| 3,619,576 | 11/1971 | Cauthen | 232/92 FP |
| 3,828,827 | 8/1974 | Witt et al. . | |
| 3,897,289 | 7/1975 | Di Paola . | |
| 4,164,963 | 8/1979 | Black | 139/11 |
| 4,359,198 | 11/1982 | Brandenberger . | |
| 4,424,836 | 1/1984 | Torii . | |
| 4,512,373 | 4/1985 | Trost | 139/DIG. 1 X |
| 4,528,732 | 7/1985 | Lichtschlag . | |
| 4,876,775 | 10/1989 | Steele et al. . | |
| 5,065,796 | 11/1991 | Roach et al. . | |

*Primary Examiner*—Andrew M. Falik
*Attorney, Agent, or Firm*—Daniel N. Hall

[57] ABSTRACT

A quick change assembly for a tire cord fabric loom utilizes a pattern of warp ends which are threaded through suitable harnesses. The pattern in the harnesses is placed in the loom and the individual warp ends are pulled back to a plurality of creel combs which are secured to the creel and which each receive and guide a group of warp strands from the creel. These warp strands are directed to the loom and are formed into the tire cord fabric having the desired pattern.

15 Claims, 5 Drawing Sheets

QUICK CHANGE ASSEMBLY FOR TIRE CORD FABRIC LOOMS

FIELD OF THE INVENTION

The present invention is directed generally to a quick change assembly for tire cord fabric looms. More particularly, the present invention is directed to a quick change assembly for reducing set-up times on tire cord fabric looms. Most specifically, the present invention is directed to a quick change assembly for use with tire cord fabric weaving looms. The harnesses and heddles, which are used in a loom to form a first tire cord fabric pattern, are taken out of a loom with the warp ends of that pattern in place. A separate set of harnesses and heddles, in which a new tire cord pattern has been set up, is placed in the loom and the warp ends of the new pattern are pulled back through the loom to creel combs that are secured to the creel. The plurality of warp ends of the new pattern are secured to the individual filament packages on the creel before start-up of the loom.

DESCRIPTION OF THE PRIOR ART

Tire cord fabrics, which are used in the construction of vehicle tires, are typically formed in a loom by weaving a plurality of warp filaments or strands with periodic placement of weft or pick filaments or strands. The looms used to actually form the tire cord fabrics are generally well known in the art and utilize a plurality of intercooperating elements to weave the fabric. A significant limitation with the prior art tire cord fabric forming looms is their inability to be quickly changed when the style of the tire cord fabric has to be changed. In the prior art devices, a plurality of strand or filament packages are each individually rotatably supported on a creel. Alternatively, a loom beam that has been wound with hundreds of ends is used instead of the creel. The strands from these various packages, or from the loom beam, are fed to the loom and form the warp threads of the tire cord fabric being woven. Each filament strand must be individually and manually fed through an aperture in a creel eye board with there typically being provided a plurality of such creel eye boards. From the creel eye boards, the plurality of strands or filaments are individually fed through a strip eyeboard in a pattern format. The plurality of filament ends then must be fed through a plurality of closed type drop wires which form a back stop motion and then through a compression section. The plurality of individual ends are then fed through a second set of closed drop wires and then through the harness heddles and reed to complete the pattern. Only after all of the warp ends have been fed through this entire assembly can the loom be operated. This procedure must be redone each time the pattern of the tire cord fabric being woven is to be changed. Such a tire cord fabric pattern change thus requires the shutting down of the loom, the removal all of the old fabric pattern warp thread ends from the loom harness, reed, stop motion devices, strip eye board and creel eyeboards, and the feeding of all of the new tire fabric pattern warp threads or filament ends back into the loom through the same array of loom elements.

In the past, the changing of a tire cord fabric pattern has either been accomplished by providing a separate loom for each of the fabric patterns being produced, or by simply accepting the production losses resulting from the time required to shut down the loom during fabric pattern changes. As the variety of tire cord fabrics patterns has increased, it has become less and less feasible to have a loom standing idle because it has been set up to run a pattern that is not being produced on a given day. At the same time, the demands for efficient utilization of equipment has made it economically unacceptable to allow a loom to remain out of production, either because the fabric pattern it is set up to run is not being produced or because of the time required to effect a fabric pattern change in a given loom.

It will thus be apparent that a need exists for a quick change assembly for tire cord fabric looms which will overcome the limitations of the prior art devices and which will allow the changing of fabric patterns in an expeditious manner. The quick change assembly in accordance with the present invention provides such a device and is a significant advance in the art.

SUMMARY OF THE INVENTION

It is an object of the present invention to provide a quick change assembly for tire cord fabric looms.

Another object of the present invention is to provide a quick change assembly for reducing set up times on looms.

A further object of the present invention is to provide a quick change assembly for use with tire cord fabric weaving looms.

Yet another object of the present invention is to provide a quick change assembly which includes the use of creel mounted combs.

Still a further object of the present invention is to provide a tire cord fabric quick change assembly which reduces loom set-up time.

As will be set forth in detail in the description of the preferred embodiment which is presented subsequently, the quick change assembly for tire cord fabric looms in accordance with the present invention utilizes a plurality of creel combs that are each used to retain and guide only a small portion of the total number of warp thread ends that are fed from strand packages on a creel to a tire cord fabric loom. A plurality of these creel combs are secured to the creel with the plurality of creel combs combining to collectively hold and guide all of the warp ends. The pattern to be produced by the loom is set up in a separate jig that holds the required harnesses and heddles. The pattern in the harnesses and heddles is placed in the loom, and the warp end threads are pulled back through the loom to the creel combs. At this point, the warp threads are secured to the strand ends from the creel packages. The warp threads are laid in the desired pattern in an expansion comb. The leading ends of the warp threads are tied down at the breast beam. Open end drop wires are dropped in place and the electrode bars are inserted to form the rear and front stop motion devices. The loom is then started.

The quick change assembly for tire cord fabrics in accordance with the present invention greatly reduces the set-up time required to effect a tire cord fabric pattern change in a loom. The use of a separate jig that holds the warp ends, the harnesses and their heddles, allows the new tire cord fabric pattern to be set up without taking an operating loom out of service. Once the loom has been shut down, the harnesses and heddles with the new pattern can be set in place and the new pattern warp ends pulled back through the compression rolls to the creel combs. Since each creel comb carries only a portion of the total number of strand ends from the strand packages on the creel, each creel comb can be set up quickly. In accordance with the present invention, each creel comb has a plurality of pins that form filament guiding dents. A top part of each creel comb is removable so that the threads or filaments can be placed in the dents between the pins in an easy, expeditious manner. The top of each creel comb can then be put back in place and secured to retain and guide the threads or filaments from the creel to the expansion comb which takes the place of the strip eye board used in the prior art devices. The stop motion devices are formed by open end drop wires that can be placed selectively over the strands or filaments as they are arranged in their new pattern. This further facilitates the quick change of a tire cord fabric pattern.

The quick change for tire cord fabric patterns in accordance with the present invention overcomes the limitations of the prior art and is a substantial advance in the art.

BRIEF DESCRIPTION OF THE DRAWINGS

While the novel features of the quick change assembly for tire cord fabrics in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
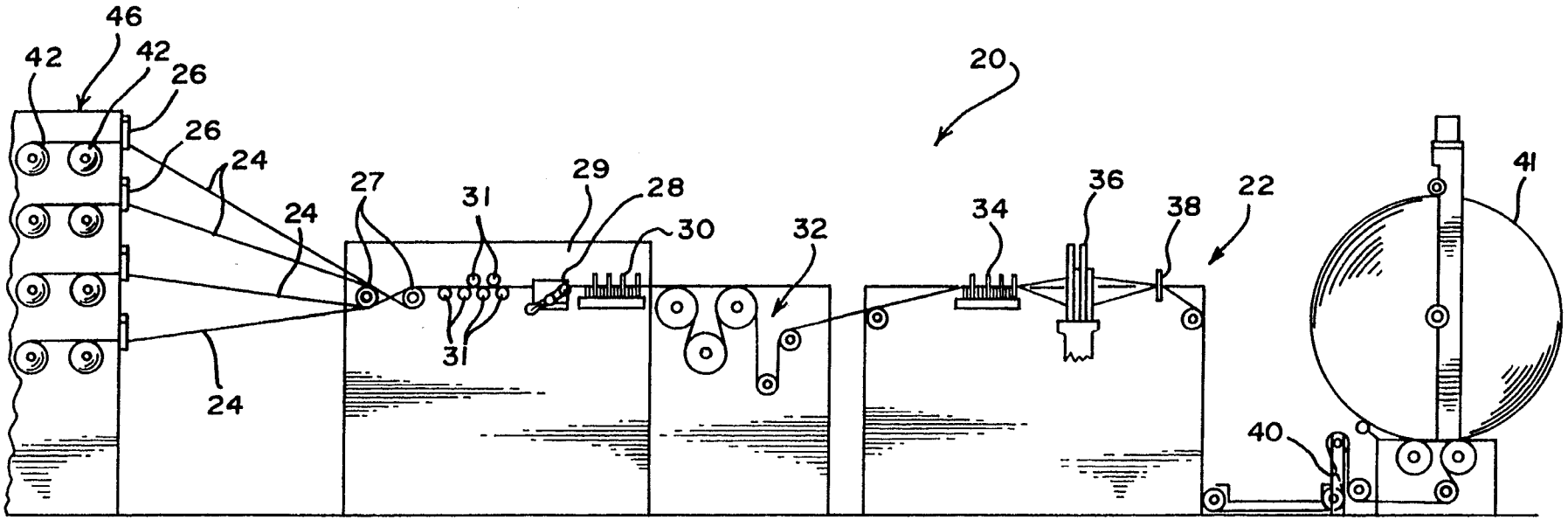
FIG. 1 is a schematic side elevation view of a tire cord fabric loom utilizing the quick change assembly of the present invention.

Referring initially to FIG. 1, there may be seen generally at 20 a preferred embodiment of a quick change assembly for tire cord fabrics in accordance with the present invention. This quick change assembly is usable in conjunction with a generally well known loom, generally at 22, to weave tire cord fabrics that find use as reinforcement in the construction of various vehicle tires. The loom 22 receives a plurality of individual warp strands 24 which are fed through a plurality of individual creel combs 26 in accordance with the present invention and as will be discussed subsequently. These individual creel combs 26 are secured to a forward portion of a creel, generally at 46, which is provided with a plurality of packages of strand material 42 as will be discussed in detail shortly. It will be understood that in the typical tire cord fabric pattern there are several hundred warp strands 24 with each such strand 24 having been provided from a separate strand package 42. Thus the depiction of only several warp strands 24 and their associated creel combs 26 and strand packages 42 will be understood to be a very schematic depiction.

Once the warp strands 24 pass through the creel combs 26, they pass over and under sequentially positioned lease rolls 27. As may be seen in FIG. 1 there are provided two such lease rolls 27 which are rotatably supported in suitable bearings between spaced side frames 29 of the loom 22. These lease rolls 27 may be solid steel or may be tubular and are caused to rotate by the drag exerted on them by the warp strands 24 passing over and under them. The purpose of the lease rolls 27 is to create a lease in the warp threads 24. The creation of a lease in the warp threads 24 by use of the lease rods 27 is beneficial in keeping the warp threads 24 properly arranged during weaving and pattern forming. The use of the lease rods 27 facilitates separation and proper alignment of the warp threads or strands 24.

After the warp threads 24 leave the lease rollers 27, they pass between a plurality of smaller guide rollers 31 which are also rotatably supported between the side frames 29 of the loom 29. These guide rollers 31 help to properly align and tension the warp strands or filaments 24.

The plurality of warp strands 24 are then passed through an expansion comb, generally at 28 and through rear stop motion devices, generally at 30. The expansion comb 28 utilizes a scissors-like expansion and contraction support and has a plurality of segments that are pivotally connected at their ends. A lead screw extends through a suitable threaded portion of each of the interconnected expansion comb segments and has a handle at one side of the loom frame 27. Rotation of the lead screw handle will cause the scissors-like expansion comb 28 to either extend or contract in width across the path of travel of the strands 24. If necessary, additional segments can be added to the expansion comb 28. This expansion comb 28 takes the place of a conventional pattern eyeboard in the loom 22 and assists in the quick change of tire cord fabric patterns in accordance with the present invention.

The rear stop motion devices 30 are situated in the direction of travel of the warp strands 24 directly after the expansion comb 28. These rear stop motion devices 30 are in the form of generally known open type drop wires that are not specifically shown. The warp strands 24, which have been arranged in a particular pattern in accordance with the type of tire cord fabric to be produced by the loom as will be discussed shortly, are then fed through a generally conventional constant tension compensator, generally at 32 and then pass through front stop motion devices 34 which are also generally conventional in nature and which utilize open type drop wires through which suitable electrode bars can be placed. The pattern of warp strands or filaments 24 then pass through an arrangement of harnesses and heddles, generally at 36, and through a reed portion 38 of the loom 22. These strands 24 are woven by the loom into a tire cord fabric 40 which is taken up by a suitable doff mechanism generally at 41.

In the preparation of a loom utilizing the quick change assembly 20 of the present invention to weave a particular tire cord fabric 40 having a specific pattern of warp strands 24, a suitable jig is utilized to hold a plurality of harnesses and heddles through which a desired pattern of warp strands can be drawn. In contrast with prior art devices in which the warp strands were taken from a loom beam and were drawn through the harnesses, in the present invention, the warp strands are not part of a loom beam. Instead, the strands are individual elements which are each 10–15 yards long. Once the pattern has been established in the harnesses at a location away from the loom 22 which will be utilized to weave the particular tire cord fabric 40, the pattern in the harnesses will be brought to the loom 22 and the harnesses 36 with the desired pattern of warp strands 24 in place will be inserted into the loom 22. Since the harnesses that have been threaded with the new pattern of warp strands 24 utilize individual warp strands 24 that are each only 10–15 yards long instead of having been threaded with strand ends from a loom beam, it is significantly easier to transport the harnesses and warp strands to the loom in accordance with the present invention than it was in the prior art method in which the harnesses and the warp beam had to be carried to the loom. At this juncture, the front and rear stop motion devices are not operational since the front and rear drop wires have been removed from the loom. The various warp strands 24 which are arranged in the desired pattern, are manually pulled through the loom 22 in a direction of travel opposite to their normal direction of travel during operation of the loom. This pulling direction is from the harness 36 and reed 38 back through the front stop motion device 34, through the constant tension compensator 32, through the rear stop motion 30, through the expansion comb 28, through the guide rollers 31 and the lease rollers 27 and back to the creel combs 26. At the individual creel combs 26 in accordance with the present invention, the individual warp strands 24 are connected to the strand ends from various forming packages 42, as may now be seen in more detail by referring to FIGS. 2*a* and 2*b*.

Figure 2A:
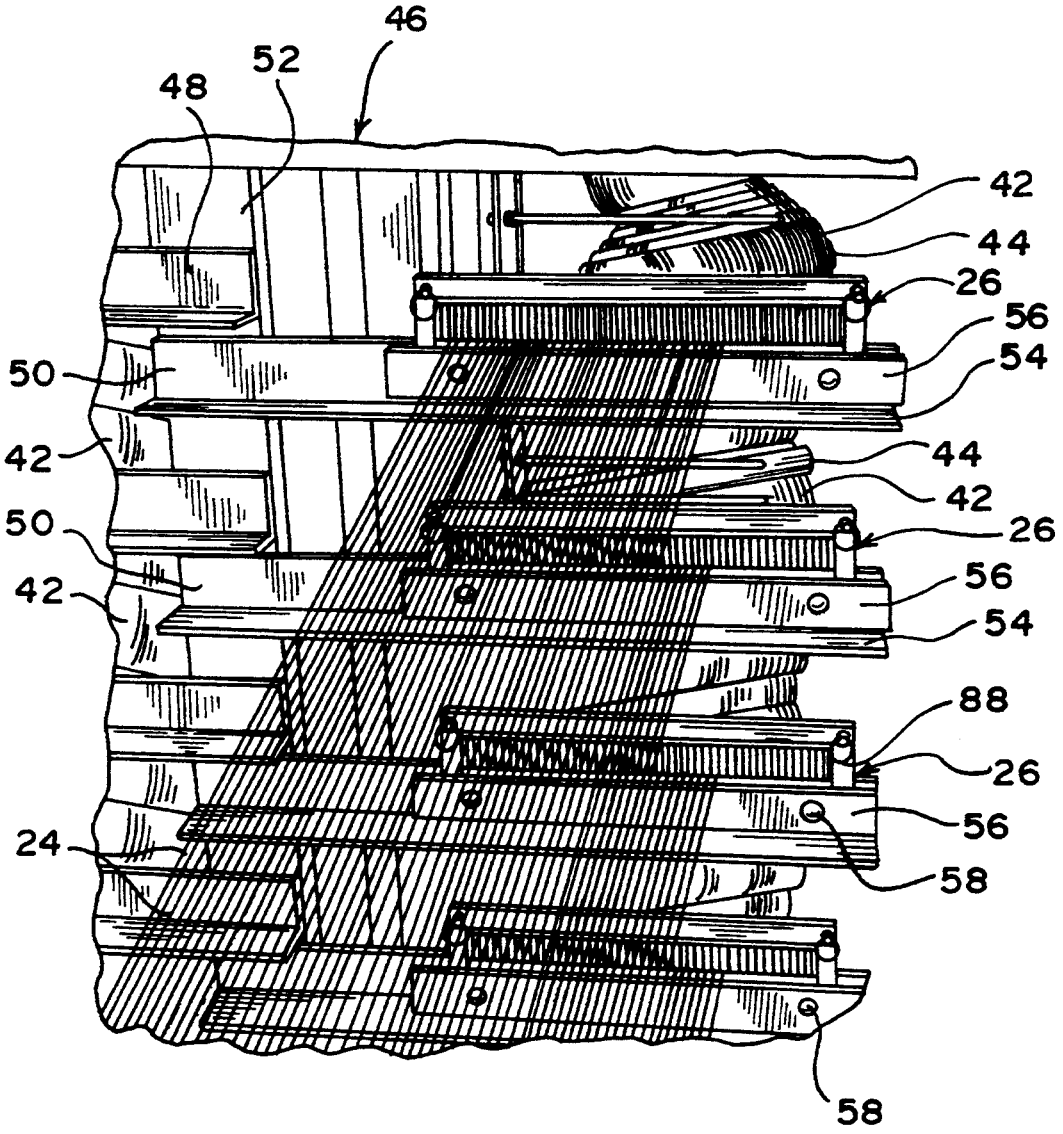
FIG. 2*a* is a perspective view of a portion of a first creel with a plurality of creel combs in accordance with the present invention.

As may be seen most clearly in FIG. 2*a* of the drawings, a plurality of packages of strand material 42 are rotatably supported on spindles 44 in a creel, generally at 46. Each of these strand packages 42 provides a single one of the strands or filaments 24 which are used in the tire cord loom 22 to form the tire cord fabric 40. As may be seen in FIG. 2*a*, and as will be appreciated by one of skill in the art, literally hundreds of these individual strands or filaments 24 are required to form a tire cord fabric 40.

In accordance with the present invention, and again as may be seen most clearly in FIG. 2*a*, a plurality of creel combs 26 are supported by laterally extending and vertically stacked creel comb support arms 48 that are secured at first or inner ends 50 to a vertical support column 52 of the creel 46. It will be understood that FIG. 2*a* is a depiction of a representative portion of one creel 46 and that the entire creel 46 will include a large number of strand or forming packages 42 and that several such creels 46 will typically be required to supply the large number of warp strands 24 which are utilized in the loom 22 to weave the tire cord fabric 40.

Each of the creel combs 26 in accordance with the present invention is removably secured to its respective support arm 48 generally adjacent a second, outer end 54 thereof. A suitable creel comb attachment bar 56 is securable to its associated creel comb support arm by suitable fasteners, such as bolts 58. The cooperation of each attachment bar 56 with its support arm 48 effectively sandwiches a lower flange portion of each creel comb 26, as will be discussed shortly, between the arm and bar to hold the creel combs 26 in place on their respective support arms 48.

Figure 2B:
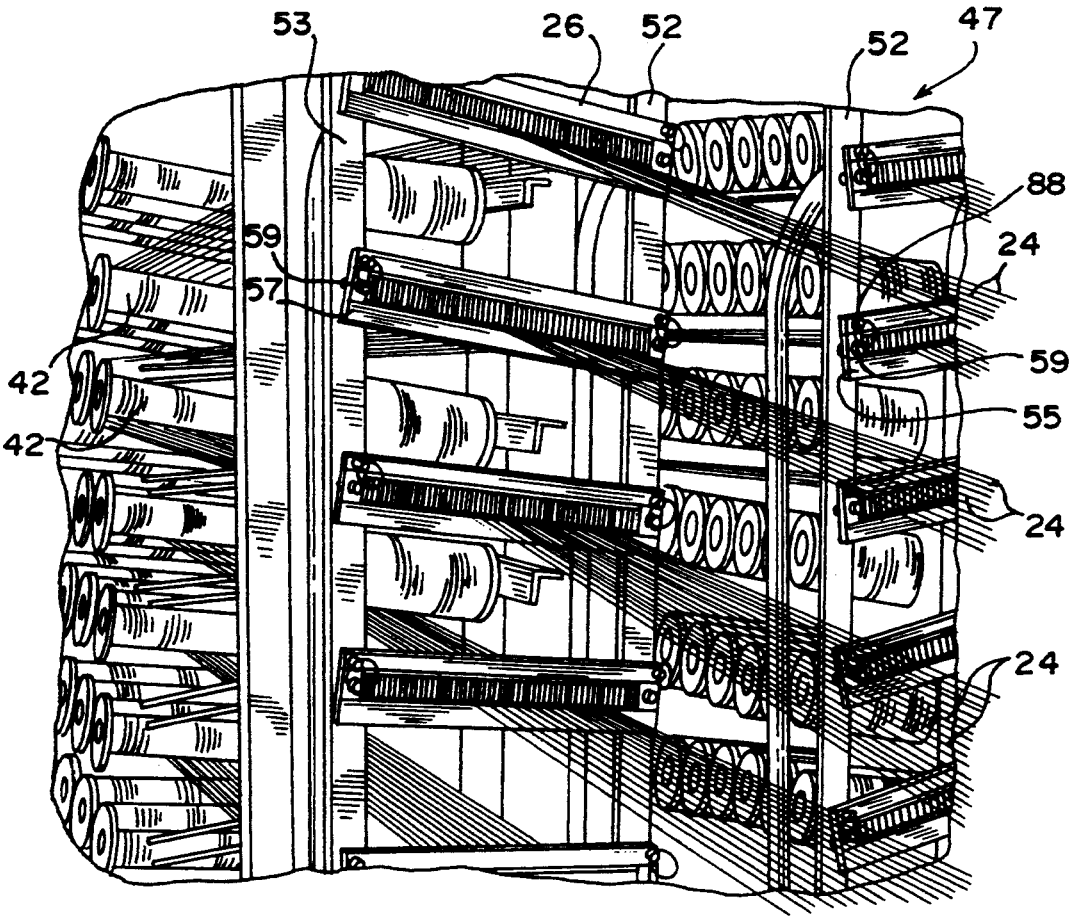
FIG. 2*b* is a perspective view of a second creel with creel combs.

A second creel arrangement 47 with a plurality of creel combs 26 is shown in FIG. 2*b*. This second creel arrangement 47 is generally similar to the first creel arrangement 46 shown in FIG. 2*a* and similar numerals for corresponding elements are used in both arrangements. In the second creel 27, each creel comb 26 is supported between spaced vertical support columns 52 and 53. Thus a first or inner end 55 of each creel comb 26 is secured by a bolt 59 to the inner vertical support column 52 while an outer end 57 of each creel comb 26 is bolted to the outer vertical support column 53 by use of a similar bolt 59. These bolts pass through suitable aligned bores and apertures in the creel combs and the vertical support columns, as will be discussed shortly.

Figure 3:
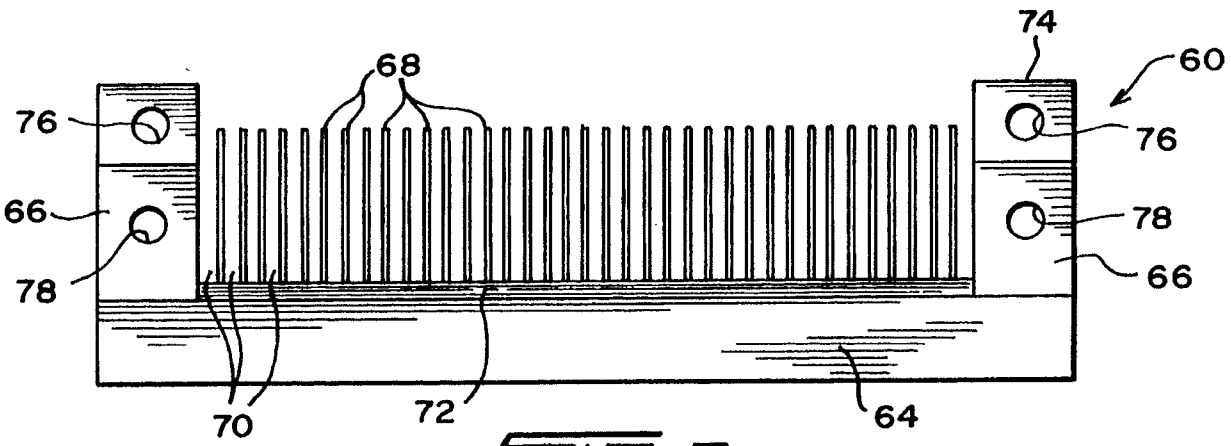
FIG. 3 is a side elevation view of a first embodiment of a creel comb in accordance with the present invention.
Figure 11:
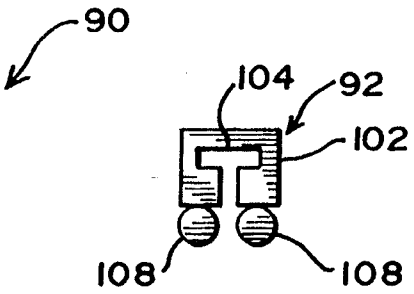
FIG. 11 is an end elevation view of the creel comb top of FIG. 10.
Figure 9:
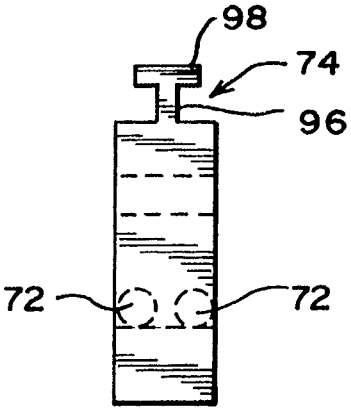
FIG. 9 is an end elevation view of the creel comb of FIG. 8.
Figure 10:
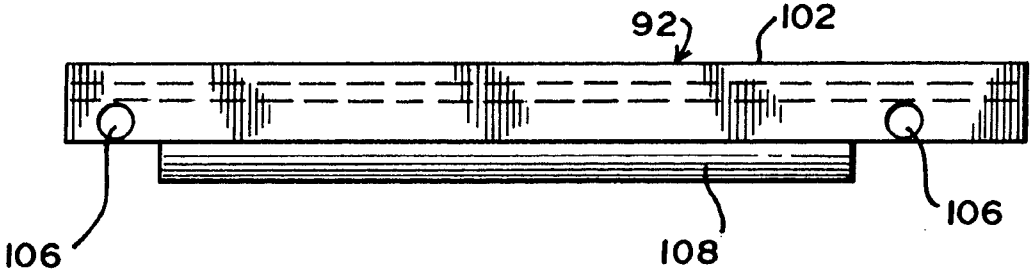
FIG. 10 is a side elevation view of a creel comb top for use with the creel comb of FIG. 8.
Figure 8:
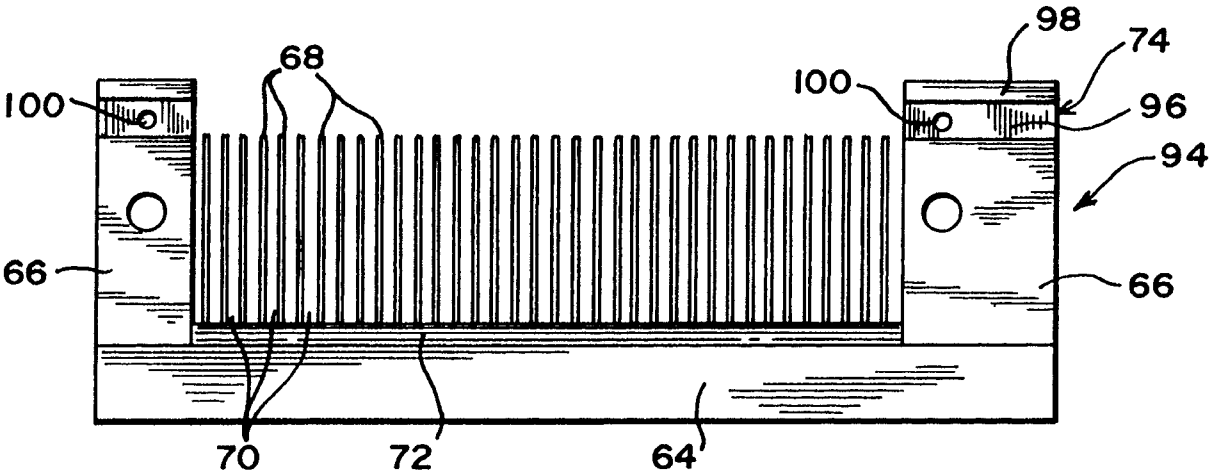
FIG. 8 is a side elevation view of a second preferred embodiment of a creel comb in accordance with the present invention.

Turning now to FIGS. 3–7, there may be seen a first preferred embodiment of a creel comb 26 in accordance with the present invention. Creel comb 26 is a two member assembly and includes a comb base 60 and a comb top 62. Referring initially to FIG. 3, the comb base 60 includes a comb base lower flange 64 with first and second spaced upstanding comb base uprights 66 at either end. The base flange 64 and the uprights 66 define a comb channel which receives a plurality of spaced, parallel, upwardly extending fine wire pins 68. These pins 68 define strand receiving spaces 70 that receive individual warp strands 24 from the packages 42. Each of the comb pins 68 extends upwardly into the comb channel from a base bar 72 that can form a running surface for the warp strands 24. In a typical creel comb 26 in accordance with the present invention there will be provided 72 pins spaced across a channel width of 11.375 inches and each having an exposed height of 1.375 inches above the base bar 72.

Figure 4:
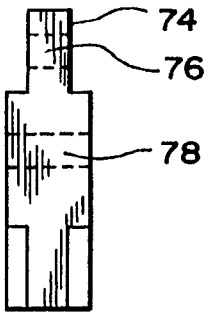
FIG. 4 is an end elevation view of the creel comb of FIG. 3.

Again referring primarily to FIGS. 3 and 4, the comb base uprights 66 each have a reduced width upper end 74 which is provided with a transverse bore 76. An intermediate bore 78 is provided in each upright 66 beneath the upper transverse bore 76. These intermediate bores 78 are usable to secure the creel comb to its support arm 48, as shown in FIG. 2*a* or between its support columns 52 and 53, as seen in FIG. 2*b*, while the upper transverse bores 76 are usable to secure the comb top 62 to the comb base 60 as will now be discussed.

Figure 6:
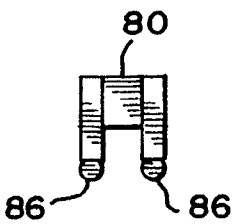
FIG. 6 is an end elevation view of the creel comb top of FIG. 5.
Figure 7:
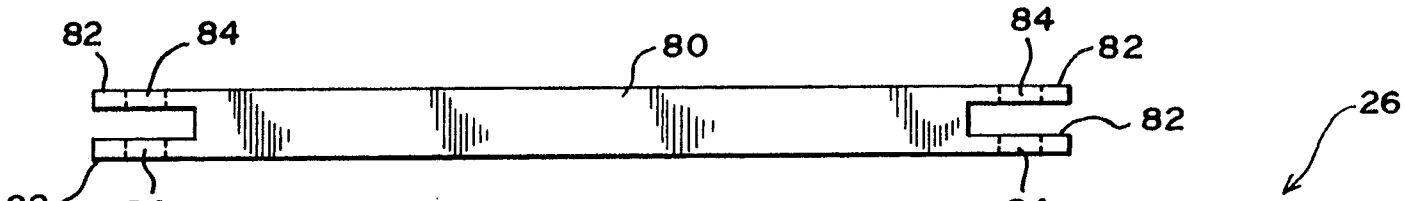
FIG. 7 is a top plan view of the creel comb top of FIG. 5.
Figure 5:
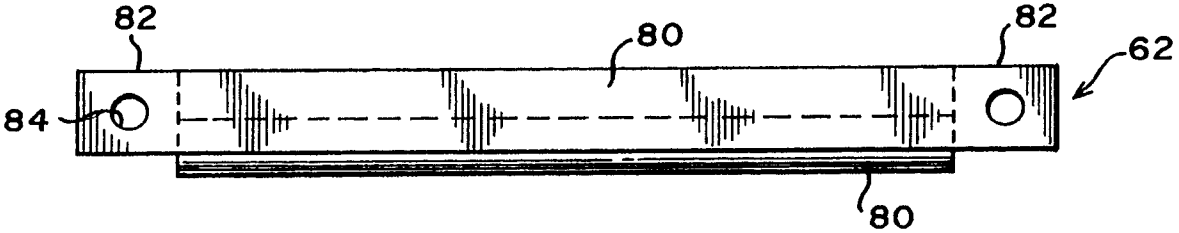
FIG. 5 is a side elevation view of a creel comb top for use with the creel comb of FIG. 3.

As is shown in FIGS. 5, 6 and 7, the comb top, generally at 62, is in the form of an elongated bar 80 that terminates at both of its ends with spaced ears 82, each of which is provided with an aperture 84. The lower surface of the comb top elongated bar 80 is provided with two elongated wire surfaces 86. These wire surfaces 86 also act as potential running surfaces for the warp strands 24 being pulled from the strand packages 42. The creel comb top 62 is securable to the creel comb base 60 by placement of the bar 80 atop the base channel with the reduced thickness upper ends 74 of the channel uprights 66 being received between the spaced ears 82 of the comb top 62. The top 62 can be secured in place by the insertion of suitable lock pins 88, as seen in FIGS. 2*a* and 2*b* through the aligned ear apertures 82 and the bore 76 at each end of the creel comb. This structure allows the top 62 of the creel comb 24 to be readily separated from the base 60 of the comb 24 during the use of the quick change assembly in accordance with the present invention. After all of the warp ends from the new pattern have been pulled back through the loom and through the creel combs 26, whose tops 62 have been removed to facilitate the insertion of the individual warp strands 24 in the intersticial spaces 70 between the pins 68, these ends 24 can be spliced to the strand ends from the various packages 42 in the creel 46. After the strands 29 have been properly placed in each of the comb creel bases 60, the tops 62 can be secured in place.

Referring now to FIGS. 8–11, there may be seen a second embodiment of a creel comb generally at 90. This second creel comb embodiment 90 in accordance with the present invention is generally similar in structure and usage to the first creel comb 26 but varies in the manner in which its comb top 92 is secured to the comb base 94. In the two embodiments of the creel comb in accordance with the present invention, the same reference numerals are utilized for corresponding elements in both combs 26 and 90. Thus the second embodiment of the creel comb base 94 includes a comb base lower flange 64 with comb base uprights 66 at its spaced longitudinal ends. A plurality of pins 68 define interstitial strand receiving spaces or dents 70 with these pins being formed of 0.075" music wire with rounded ends, as was the case in the first embodiment. One or more lower running surfaces are provided at 72 and support the warp strand 24 when the creel comb 90 is in use. The difference between this second creel comb 90 and the first creel comb embodiment 26 resides in the securement of the comb top 92 to the comb base 94. In this second embodiment, the upper portion 74 of the comb base uprights 66 are each generally T-shaped in cross-section, as may be seen most clearly in FIG. 9. This T-shape is formed by a thin web 96 that terminates in an upper flange 98. As may be seen most clearly in FIG. 8 a bore 100 is formed in web 96 and is for the same purpose as the corresponding bore 76 in the first preferred embodiment 26 of the creel comb.

The creel comb top 92 of the second preferred embodiment of the creel comb 90 in accordance with the present invention has an elongated bar 102. As may be seen in FIG. 11, this bar 102 has a generally T-shaped channel or slot 104 extending longitudinally along the length of the bar 102. This T-shaped channel or slot 104 is shaped to slidingly receive the T-shaped upper ends 74 of the comb base uprights 66 of the second embodiment 90 of the creel comb in accordance with the present invention. The comb top 92 also has spaced apertures 106 adjacent its ends which are positioned to align with the bores 100 in the comb base uprights in the same manner as in the first preferred embodiment of the creel comb 26. These aligned bores 100 and apertures 106 will receive a lock pin 88, as seen in FIGS. 2a and 2b when the creel comb top bar 92 is slid into place atop the creel comb base 94 after the warp strands 24 have been placed in the interstices 70 between the pins 68. The top 92 of the creel comb 90 also is provided with spaced, parallel wire elements 108 that form rounded running surfaces against which the tire cord fabric forming strands 24 may run on their way from the creel packages 42 to the loom 24.

In both preferred embodiments of the creel comb 24 or 90 in accordance with the present invention, the bottom, sides and top are made of brass. The pins are made from 0.075" music wire with rounded ends. Appropriately sized music wire is soldered to the top and bottom of the sheet openings to form the running surfaces 72, 86 and 108. The entire comb is chrome plated after assembly.

In operation, the pattern of individual warp threads to be utilized in the tire cord fabric to be woven by the loom 22 of the present invention is prepared in a jig that supports a plurality of harnesses 36. This pattern is then transferred to the loom 22 where the harnesses 36 are put in place. The warp end threads are unrolled and are threaded back around the compressor rolls 32, the guide rolls 31, and the lease rolls 27. These individual warp threads 24 are then brought back to the creel combs 26. In accordance with the present invention, the tops 62 or 92 of the creel combs 26 or 90 are removed and the warp ends 24 are spliced to the strand package ends behind the creel combs. Once this has been done, the strands 24 are placed in the proper interstices 70 between the pins 68 of the creel combs and the expansion comb ends are laid in the expansion comb 28 in the proper pattern. The warp ends are tied down at the breast board and the loom is started. The open end drop wires are dropped in at the rear and front stop motion devices 30 and 34 and the tire cord fabric with the desired pattern is produced by the loom 22 and taken up by the fabric beam on the doffing mechanism 41.

While a preferred embodiment of a quick change assembly for tire cord fabrics in accordance with the present invention has been set forth fully and completely hereinabove, it will be apparent to one of skill in the art that a number of changes in, for example, the overall number of tire cord strands, the type of doff mechanism used, the size and specific operation of the loom and the like could be made without departing from the true spirit and scope of the present invention which is accordingly to be limited by the following claims.

I claim:

1. A quick change assembly for a tire cord fabric pattern comprising:

a loom having a harness and reed for use in weaving a tire cord fabric having a selected pattern;

a creel provided with a plurality of strand packages each having a warp strand usable in said loom;

a plurality of creel combs secured to said creel, each of said creel combs receiving warp strands from a selected group of said plurality of strand packages; and means on said creel combs to facilitate placement of said selected group of warp strands in each of said creel combs.

2. The quick change assembly of claim 1 wherein each of said creel combs includes a creel comb base and a creel comb top.

3. The quick change assembly of claim 2 wherein each of said creel comb bases has a comb base lower flange with spaced comb base uprights at end portions of said comb base lower flange.

4. The quick change assembly of claim 3 wherein said comb base lower flange and said comb base uprights define a comb base channel and further wherein a plurality of spaced pins are positioned in said channel and form interstitial spaces for receipt of said warp strands.

5. The quick change assembly of claim 3 wherein said base uprights have upper ends which are shaped to cooperatively receive ends of said creel comb top.

6. The quick change assembly of claim 5 wherein said base upright ends have a reduced thickness and further wherein said creel comb top ends have spaced ears which are positionable about said reduced thickness upper end of said comb base uprights.

7. The quick change assembly of claim 5 wherein said comb base upright ends are generally T-shaped and further wherein said comb top has an elongated slot which is shaped to slidably receive said T-shaped comb base upright ends.

8. The quick change assembly of claim 1 wherein said creel includes a plurality of laterally extending, vertically spaced creel comb support arms and further wherein one of said plurality of creel combs is removably secured to each of said plurality of creel comb support arms.

9. The quick change assembly of claim 1 wherein said creel includes a plurality of vertically extending spaced support columns and further wherein each of said plurality of creel combs is removably secured to first and second ones of said spaced support columns.

10. The quick change assembly of claim 1 further including first and second lease rolls in said loom intermediate said harness and said creel, said lease rolls forming a lease in said warp strands.

11. The quick change assembly of claim 10 wherein said first and second lease rolls are rotatably supported between side frames of said loom.

12. The quick change assembly of claim 1 further including an expansion comb positioned in said loom intermediate said harness and said creel, said expansion comb receiving said warp strands from said creel combs.

13. A method of changing a tire cord fabric pattern in a tire cord fabric weaving loom including:

setting up a pattern of warp thread ends in a loom harness;

placing said pattern of warp threads in said harness into a tire cord fabric weaving loom;

pulling said warp thread ends in said pattern through said loom against a normal direction of warp thread travel;

providing a plurality of strand packages having strand ends in a creel assembly;

securing a plurality of creel combs to said creel assembly;

securing said warp thread ends to said strand ends from said strand packages;

placing said warp thread ends in said creel comb in said pattern; and operating said tire cord fabric weaving loom to form said tire cord fabric pattern.

14. The method of claim 13 further including providing each of said plurality of creel combs with a removable top and removing said creel comb top during said placing of said warp thread ends in said creel combs.

15. The method of claim 13 further including providing lease rolls intermediate said loom harness and said creel combs and guiding said warp threads around said lease rolls and forming a lease in said warp threads.

* * * * *